US007908863B2

(12) United States Patent
Hessler

(10) Patent No.: US 7,908,863 B2
(45) Date of Patent: Mar. 22, 2011

(54) FUEL NOZZLE FOR A GAS TURBINE ENGINE AND METHOD FOR FABRICATING THE SAME

(75) Inventor: William Kirk Hessler, Greer, SC (US)

(73) Assignee: General Electric Company, Schenectady, NY (US)

( * ) Notice: Subject to any disclaimer, the term of this patent is extended or adjusted under 35 U.S.C. 154(b) by 699 days.

(21) Appl. No.: 12/069,870

(22) Filed: Feb. 12, 2008

(65) Prior Publication Data

US 2009/0199561 A1 Aug. 13, 2009

(51) Int. Cl.
*F02C 1/00* (2006.01)
*F02G 3/00* (2006.01)

(52) U.S. Cl. ..... 60/740; 60/737; 60/746; 60/752

(58) Field of Classification Search ..... 60/737, 60/733, 740, 742, 746, 747, 752; 239/518
See application file for complete search history.

(56) References Cited

U.S. PATENT DOCUMENTS 3,792,582 A * 2/1974 Markowski ..... 60/737
5,193,346 A * 3/1993 Kuwata et al. ..... 60/737
5,259,184 A * 11/1993 Borkowicz et al. ..... 60/39.55
5,408,830 A * 4/1995 Lovett ..... 60/737
5,435,126 A * 7/1995 Beaudoin ..... 60/39.463
5,491,970 A * 2/1996 Davis et al. ..... 60/776
5,685,139 A * 11/1997 Mick et al. ..... 60/776
6,282,904 B1 * 9/2001 Kraft et al. ..... 60/739
6,598,383 B1 * 7/2003 Vandervort et al. ..... 60/773
6,675,581 B1 * 1/2004 Stuttaford et al. ..... 60/737
6,684,641 B2 * 2/2004 Moriya et al. ..... 60/737
6,691,516 B2 * 2/2004 Stuttaford et al. ..... 60/737
6,722,132 B2 * 4/2004 Stuttaford et al. ..... 60/737
6,786,047 B2 9/2004 Bland et al.
6,910,336 B2 6/2005 Sullivan et al.
6,915,636 B2 7/2005 Stuttaford et al.
6,951,097 B2 * 10/2005 Moriya et al. ..... 60/39.465
7,165,405 B2 1/2007 Stuttaford et al.
7,318,317 B2 1/2008 Carrea
7,707,833 B1 * 5/2010 Bland et al. ..... 60/737
7,757,491 B2 * 7/2010 Hessler ..... 60/746
2003/0110774 A1 * 6/2003 Saitoh ..... 60/737
2004/0006989 A1 1/2004 Stuttaford et al.
2005/0274827 A1 12/2005 Henriquez
2007/0137220 A1 6/2007 Carrea

* cited by examiner

*Primary Examiner* — William H Rodríguez
(74) *Attorney, Agent, or Firm* — Armstrong Teasdale LLP

(57) ABSTRACT

A method for fabricating a secondary fuel nozzle assembly includes providing a nozzle portion defining a passageway configured to supply fuel. At least one peg is operatively coupled in fuel flow communication with the passageway. The at least one peg extends radially outward from the nozzle portion and defines at least one opening configured to direct a flow of fuel in a substantially upstream direction. A disc is positioned about the nozzle portion upstream of the at least one peg. The disc is positioned in communication with the at least one opening and configured to interfere with the flow of fuel to facilitate fuel atomization.

19 Claims, 3 Drawing Sheets

FUEL NOZZLE FOR A GAS TURBINE ENGINE AND METHOD FOR FABRICATING THE SAME

BACKGROUND OF THE INVENTION

This invention relates generally to combustion systems for use with gas turbine engines and, more particularly, to fuel nozzles used with gas turbine engines.

Conventional gas turbine engines include secondary fuel nozzle assemblies that direct fuel into a flow of combustion gases that moves through a combustor assembly in a downstream direction along the secondary fuel nozzle. Some secondary fuel nozzle assemblies include fuel pegs that extend into the flow of combustion gases to facilitate directing the fuel into the combustion gas flow. In these conventional secondary fuel nozzle assemblies, the fuel pegs form openings that are oriented in the downstream direction to facilitate mixing the fuel with the flow of combustion gases as the combustion gases travel across the fuel pegs. As the fuel is directed into the flow of combustion gases, the fuel is carried with the combustion gases. However, in some conventional gas turbine engines, the fuel is not dispersed throughout the combustion gases but rather flows as a separate stream within the combustion gases.

BRIEF DESCRIPTION OF THE INVENTION

In one aspect, a method for fabricating a secondary fuel nozzle assembly is provided. The method includes providing a nozzle portion defining a passageway configured to supply fuel. At least one peg is operatively coupled in fuel flow communication with the passageway. The at least one peg extends radially outward from the nozzle portion and defines at least one opening configured to direct a flow of fuel in a substantially upstream direction. A disc is positioned about the nozzle portion upstream of the at least one peg. The disc is positioned in communication with the at least one opening and configured to interfere with the flow of fuel to facilitate fuel atomization.

In another aspect, a secondary fuel nozzle assembly is provided. The secondary fuel nozzle assembly includes a nozzle portion and at least one peg extending radially outward from the nozzle portion. The at least one peg defines at least one opening configured to direct a flow of fuel in a substantially upstream direction. A disc is positioned about the nozzle portion upstream of the at least one peg. The disc is positioned in flow communication with the at least one opening and configured to interfere with the flow of fuel to facilitate fuel atomization.

In another aspect, a combustor assembly for use with a gas turbine engine is provided. The combustor assembly includes a combustor liner defining a primary combustion zone and a secondary combustion zone. The combustor liner is configured to direct a flow of combustion gases substantially in a downstream direction. A primary fuel nozzle assembly extends into the primary combustion zone and a secondary fuel nozzle assembly extends through the primary combustion zone and into the secondary combustion zone. The secondary fuel nozzle assembly includes a nozzle portion and at least one peg extending radially outward from the nozzle portion. The at least one peg defines at least one opening configured to direct a flow of fuel in an upstream direction opposing the downstream direction. A disc is positioned about the nozzle portion upstream of the at least one peg, and configured to interfere with the flow of fuel to facilitate fuel atomization.

DETAILED DESCRIPTION OF THE INVENTION

Figure 1:
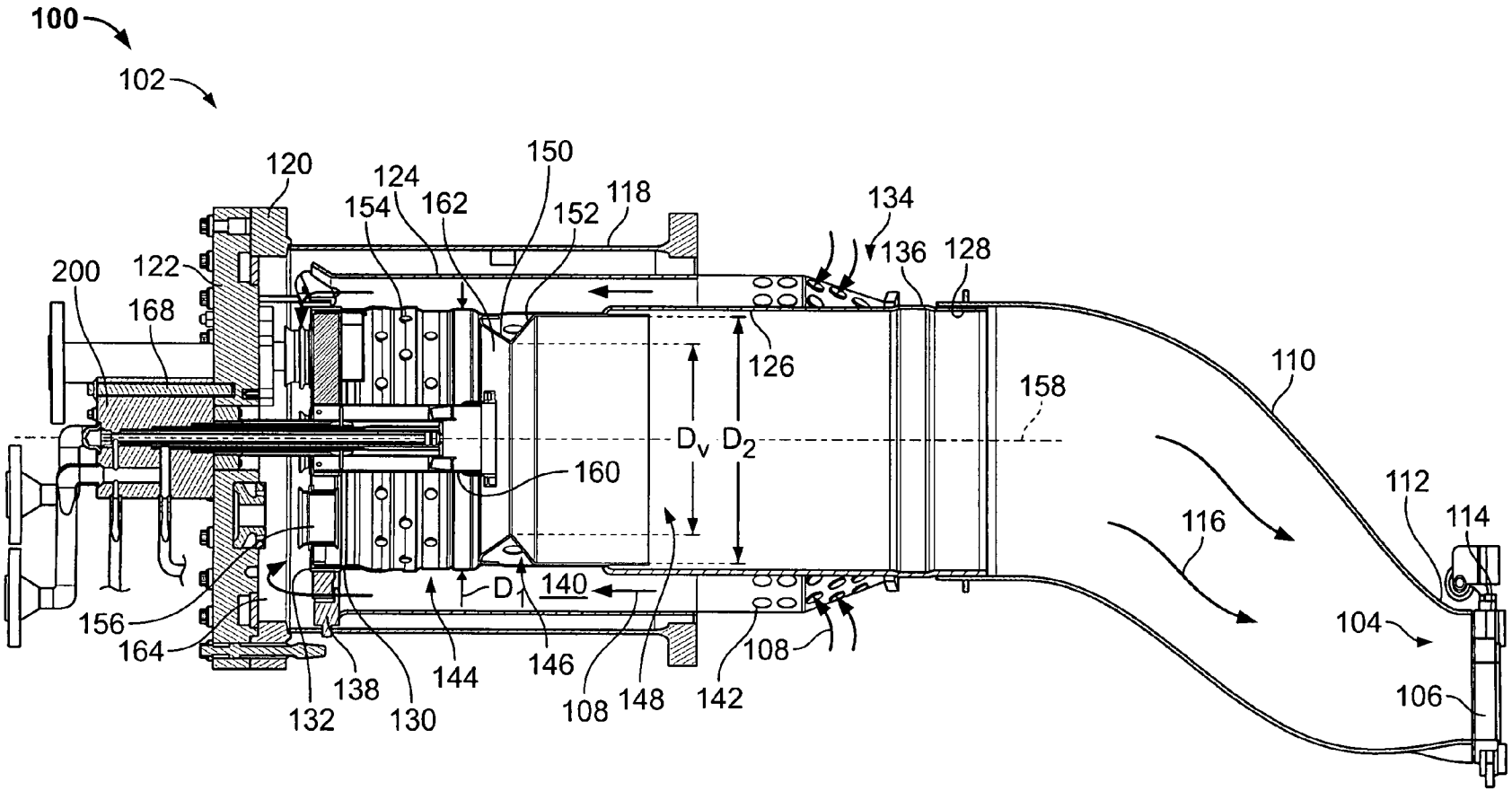
FIG. 1 is partial cross-sectional view of an exemplary gas turbine combustion system.

FIG. 1 is partial cross-sectional view of an exemplary gas turbine engine 100 that includes a secondary fuel nozzle assembly 200. Gas turbine engine 100 includes a compressor (not shown), a combustor 102, and a turbine 104. Only a first stage nozzle 106 of turbine 104 is shown in FIG. 1. In the exemplary embodiment, the turbine is rotatably coupled to the compressor with rotors (not shown) that are coupled together via a single common shaft (not shown). The compressor pressurizes inlet air 108 prior to it being discharged to combustor 102 wherein it cools combustor 102 and provides air for the combustion process. More specifically, air 108 channeled to combustor 102 flows in a direction generally opposite to the flow of air through gas turbine engine 100. In the exemplary embodiment, gas turbine engine 100 includes a plurality of combustors 102 that are spaced circumferentially about an engine casing (not shown). In one embodiment, combustors 102 are can-annular combustors.

In the exemplary embodiment, gas turbine engine 100 includes a transition duct 110 that extends between an outlet end 112 of each combustor 102 and an inlet end 114 of turbine 104 to channel combustion gases 116 into turbine 104. Further, in the exemplary embodiment, each combustor 102 includes a substantially cylindrical combustor casing 118. Combustor casing 118 is coupled to the engine casing using bolts (not shown), mechanical fasteners (not shown), welding, and/or any other suitable coupling means that enables gas turbine engine 100 to function as described herein. In the exemplary embodiment, a forward end 120 of combustor casing 118 is coupled to an end cover assembly 122. End cover assembly 122 includes supply tubes, manifolds, valves for channeling gaseous fuel, liquid fuel, air and/or water to the combustor, and/or any other components that enable gas turbine engine 100 to function as described herein.

In the exemplary embodiment, a substantially cylindrical flow sleeve 124 is coupled within combustor casing 118 such that flow sleeve 124 is substantially concentrically aligned with combustor casing 118. A combustor liner 126 is coupled substantially concentrically within flow sleeve 124. More specifically, combustor liner 126 is coupled at an aft end 128 to transition duct 110, and at a forward end 130 to a combustor liner cap assembly 132. Flow sleeve 124 is coupled at an aft end 134 to an outer wall 136 of combustor liner 126 and coupled at a forward end 138 to combustor casing 118. Alternatively, flow sleeve 124 may be coupled to casing 118 and/or combustor liner 126 using any suitable coupling assembly that enables gas turbine engine 100 to function as described herein. In the exemplary embodiment, an air passage 140 is defined between combustor liner 126 and flow sleeve 124. Flow sleeve 124 includes a plurality of apertures 142 defined therein that enable compressed air 108 from the compressor to enter air passage 140. In the exemplary embodiment, air 108 flows in a direction that is opposite to a direction of core flow (not shown) from the compressor towards end cover assembly 122.

Combustor liner 126 defines a primary combustion zone 144, a venturi throat region 146, and a secondary combustion zone 148. More specifically, primary combustion zone 144 is upstream from secondary combustion zone 148. Primary combustion zone 144 and secondary combustion zone 148 are separated by venturi throat region 146. Venturi throat region 146 has a generally narrower diameter $D_v$ than the diameters $D_1$ and $D_2$ of respective combustion zones 144 and 148. More specifically, throat region 146 includes a converging wall 150 and a diverging wall 152. Converging wall 150 tapers from diameter $D_1$ to $D_v$ and diverging wall 152 widens from $D_v$ to $D_2$. As such, venturi throat region 146 functions as an aerodynamic separator or isolator to facilitate reducing flashback from secondary combustion zone 148 to primary combustion zone 144. In the exemplary embodiment, primary combustion zone 144 includes a plurality of apertures 154 defined therethrough that enable air 108 to enter primary combustion zone 144 from air passage 140.

Further, in the exemplary embodiment, combustor 102 also includes a plurality of spark plugs (not shown) and a plurality of cross-fire tubes (not shown). The spark plugs and cross-fire tubes extend through ports (not shown) defined in combustor liner 126 within primary combustion zone 144. The spark plugs and cross-fire tubes ignite fuel and air within each combustor 102 to create combustion gases 116.

In the exemplary embodiment, at least one secondary fuel nozzle assembly 200 is coupled to end cover assembly 122. More specifically, in the exemplary embodiment, combustor 102 includes one secondary fuel nozzle assembly 200 and a plurality of primary fuel nozzle assemblies 156. More specifically, in the exemplary embodiment, primary fuel nozzle assemblies 156 are arranged in a generally circular array about a centerline 158 of combustor 102, and a centerline 201 (shown in FIG. 2) of secondary fuel nozzle assembly 200 is substantially aligned with combustor centerline 158. Alternatively, primary fuel nozzle assemblies 156 may be arranged in non-circular arrays. In an alternative embodiment, combustor 102 may include more or less than one secondary fuel nozzle assembly 200. Although, only primary fuel nozzle assembly 156 and secondary fuel nozzle assembly 200 are described herein, more or less than two types of nozzle assemblies, or any other type of fuel nozzle, may be included in combustor 102. In the exemplary embodiment, secondary fuel nozzle assembly 200 includes a tube assembly 160 that substantially encloses a portion of secondary fuel nozzle assembly 200 that extends through primary combustion zone 144.

Primary fuel nozzle assemblies 156 partially extend into primary combustion zone 144, and secondary fuel nozzle assembly 200 extends through primary combustion zone into an aft portion 162 of throat region 146. As such, fuel (not shown) injected from primary fuel nozzle assemblies 156 is combusted substantially within primary combustion zone 144, and fuel (not shown) injected from secondary fuel nozzle assembly 200 is combusted substantially within secondary combustion zone 148.

In the exemplary embodiment, combustor 102 is coupled to a fuel supply (not shown) for supplying fuel to combustor 102 through fuel nozzle assemblies 156 and/or 200. For example, pilot fuel (not shown) and/or main fuel (not shown) may be supplied through fuel nozzle assemblies 156 and/or 200. In the exemplary embodiment, both pilot fuel and main fuel are supplied through both primary fuel nozzle assembly 156 and secondary fuel nozzle assembly 200 by controlling the transfer of fuels to primary fuel nozzle assembly 156 and secondary fuel nozzle assembly 200, as described in more detail below. As used herein "pilot fuel" refers to a small amount of fuel used as a pilot flame, and "main fuel" refers to the fuel used to create the majority of combustion gases 116. Fuel may be natural gas, petroleum products, coal, biomass, and/or any other fuel, in solid, liquid, and/or gaseous form that enables gas turbine engine 100 to function as described herein. By controlling fuel flows through fuel nozzle assemblies 156 and/or 200, a flame (not shown) within combustor 102 may be adjusted to a pre-determined shape, length, and/or intensity to effect emissions and/or power output of combustor 102.

In operation, air 108 enters gas turbine engine 100 through an inlet (not shown). Air 108 is compressed in the compressor and compressed air 108 is discharged from the compressor towards combustor 102. Air 108 enters combustor 102 through apertures 142 and is channeled through air passage 140 towards end cover assembly 122. Air 108 flowing through air passage 140 is forced to reverse its flow direction at a combustor inlet end 164 and is channeled into combustion zones 144 and/or 148 and/or through throat region 146. Fuel is supplied into combustor 102 through end cover assembly 122 and fuel nozzle assemblies 156 and/or 200. Ignition is initially achieved when a control system (not shown) initiates a starting sequence of gas turbine engine 100, and the spark plugs are retracted from primary combustion zone 144 once a flame has been continuously established. At aft end 128 of combustor liner 126, hot combustion gases 116 are channeled through transition duct 110 and turbine nozzle 106 towards turbine 104.

Figure 2:
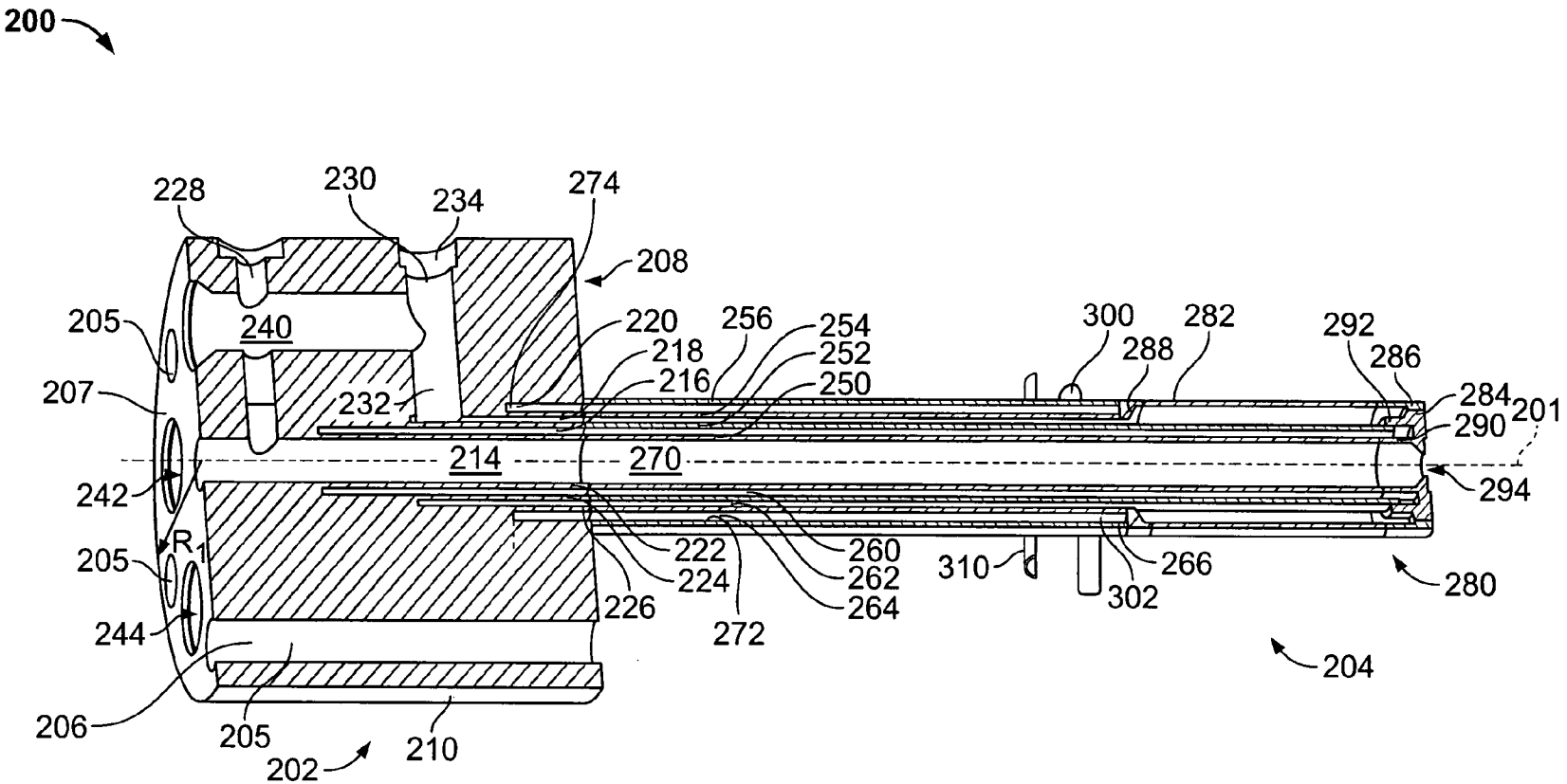
FIG. 2 is a cross-sectional view of an exemplary fuel nozzle assembly that may be used with the gas turbine combustion system shown in FIG. 1.
Figure 3:
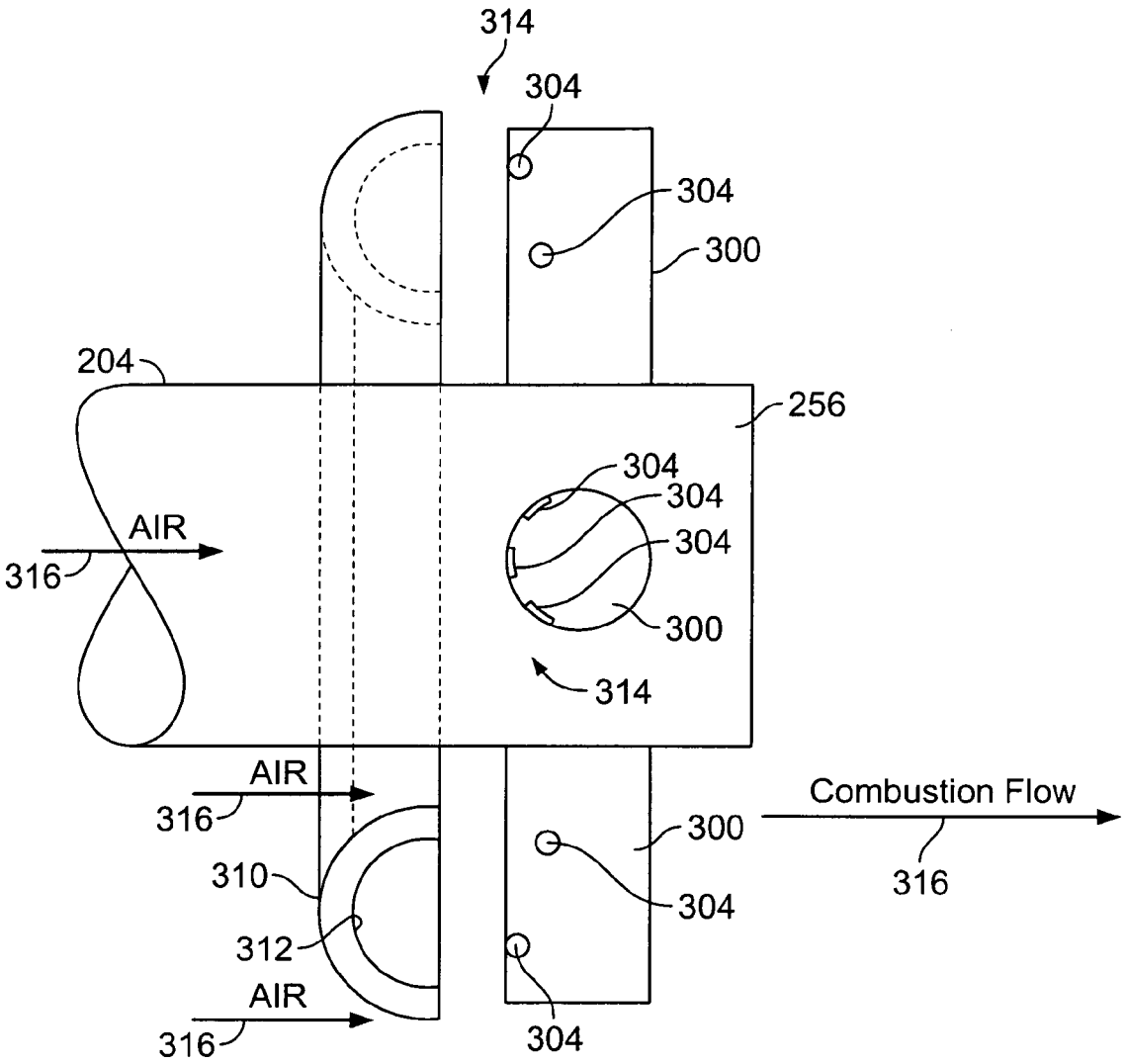
FIG. 3 is a partial view of the exemplary fuel nozzle assembly shown in FIG. 2.

FIG. 2 is a cross-sectional view of an exemplary secondary fuel nozzle assembly 200 that may be used with combustor 102 (shown in FIG. 1). FIG. 3 is a partial sectional view of a portion of secondary fuel nozzle assembly 200.

In the exemplary embodiment, secondary fuel nozzle assembly 200 includes head portion 202 and a nozzle portion 204 described in greater detail below. Head portion 202 enables secondary fuel nozzle assembly 200 to be coupled within combustor 102. For example, in one embodiment, head portion 202 is coupled to end cover assembly 122 (shown in FIG. 1) and is secured thereto using a plurality of mechanical fasteners 168 (shown in FIG. 1) such that head portion 202 is external to combustor 102 and nozzle portion 204 extends through end cover assembly 122. In the exemplary embodiment, head portion 202 includes a plurality of circumferentially-spaced openings 205 that are each sized to receive a mechanical fastener therethrough. Head portion 202 may include any suitable number of openings 205 that enable secondary fuel nozzle assembly 200 to be secured within combustor 102 and to function as described herein. Moreover, although an inner surface 206 of each opening 205 is shown as being substantially smooth, openings 205 may be threaded. In addition, although each opening 205 is shown as extending substantially parallel to centerline 201 of secondary fuel nozzle assembly 200, openings 205 may have any orientation that enables secondary fuel nozzle assembly 200 to function as described herein. Alternatively, head portion 202 is not limited to being coupled to combustor 102 using only mechanical fasteners 168, but rather may be coupled to combustor 102 using any coupling means that enables secondary fuel nozzle assembly 200 to function as described herein.

In the exemplary embodiment, head portion 202 is substantially cylindrical and includes a first substantially planar end face 207, an opposite second substantially planar end face 208, and a substantially cylindrical body 210 extending therebetween.

Head portion 202 includes, in the exemplary embodiment, a center passageway 214 and a plurality of concentrically aligned channels 216, 218, and 220. More specifically, center passageway 214 extends from first end face 207 to second end face 208 along centerline 201. Further, in the exemplary embodiment, channels 216, 218, and 220 each extend partially from second end face 208 towards first end face 207, as described in more detail below.

In the exemplary embodiment, a plurality of concentrically aligned channel divider walls 222, 224, and 226 in head portion 202 define center passageway 214, channels 216, 218, and 220. More specifically, in the exemplary embodiment, center passageway 214 is defined by a first divider wall 222, first channel 216 is defined between first divider wall 222 and a second divider wall 224, second channel 218 is defined between second divider wall 224 and a third divider wall 226, and third channel 220 is defined between third divider wall 226 and body 210.

In the exemplary embodiment, head portion 202 also includes a plurality of radial inlets. A first radial inlet 228 extends through body 210 to center passageway 214, a second radial inlet (not shown) extends through body 210 to first channel 216, a third radial inlet 230 extends through body 210 to second channel 218, and a fourth radial inlet (not shown) extends through body 210 to third channel 220. Although in the exemplary embodiment only one radial inlet is in flow communication with corresponding center passageway 214, or channel 216, 218, or 220, in alternative embodiments, more than one radial inlet may be in flow communication with center passageway 214, or corresponding channel 216, 218, or 220.

In the exemplary embodiment, each radial inlet, such as first radial inlet 328 and/or third radial inlet 230, has a substantially constant diameter along its respective inlet length. Alternatively, each radial inlet may be formed with a non-circular cross-sectional shape and/or a varied diameter. More specifically, the radial inlets may be configured in any suitable shape and/or orientation that enables combustor 102 and/or secondary fuel nozzle assembly 200 to function as described herein. Further, in the exemplary embodiment, first radial inlet 228 includes a corresponding radial port 232 and third radial inlet 230 includes a corresponding radial port 234. Each port 232 and/or 234 may be a tapered port, a straight port, or an offset port. Alternatively, ports 232 and/or 234 may be configured in any suitable shape and/or orientation that enable combustor 102 and secondary fuel nozzle assembly 200 to function as describe herein.

Head portion 202 also includes, in the exemplary embodiment, a plurality of axial inlets 240, 242, and 244. Although only three axial inlets 240, 242, and 244 are described, head portion 202 may include any number of axial inlets that enables secondary fuel nozzle assembly 200 to function as described herein. In the exemplary embodiment, axial inlet 240 extends from first end face 204, through radial inlet 228, to radial inlet 230. Although, in the exemplary embodiment, axial inlet 240 extends through radial inlet 228, axial inlet 240 may extend from first end face 204 to any radial inlet, with or without extending through another radial inlet such that secondary fuel nozzle assembly 200 functions as described herein.

In the exemplary embodiment, axial inlets 240, 242, and/or 244 have a substantially constant diameter. Alternatively, axial inlets 240, 242, and/or 244 may have a non-circular cross-sectional shape and/or a variable diameter. Moreover, in the exemplary embodiment, axial inlets 240, 242, and/or 244 include a tapered port. Alternatively, the port may have any suitable shape that enables combustor 102 and/or secondary fuel nozzle assembly 200 to function as describe herein.

In the exemplary embodiment, nozzle portion 204 is coupled to head portion 202 by, for example, welding nozzle portion 204 to head portion 202. Although in the exemplary embodiment nozzle portion 204 is cylindrical, nozzle portion 204 may be any suitable shape that enables secondary fuel nozzle assembly 200 to function as described herein.

Nozzle portion 204, in the exemplary embodiment, includes a plurality of substantially concentrically-aligned tubes 250, 252, 254, and 256. Tubes 250, 252, 254, and 256 are oriented with respect to each other such that a plurality of substantially concentric passageways 260, 262, 264, and 266 are defined within nozzle portion 204. More specifically, in the exemplary embodiment, a center passageway 270 is defined within a first tube 250, a first passageway 260 is defined between first tube 250 and a second tube 252, a second passageway 262 is defined between second tube 252 and a third tube 254, and a third passageway 264 is defined between third tube 254 and a fourth tube 256. Although the exemplary embodiment includes four concentrically-aligned tubes 250, 252, 254, and 256, nozzle portion 204 may include any number of tubes that enables secondary fuel nozzle assembly 200 and/or combustor 102 to function as described herein. In the exemplary embodiment, the number of tubes is such that the number of passageways defined by the tubes is equal to the number of head channels and head center passageway.

In the exemplary embodiment, channels 216, 218, and 220 are substantially concentrically-aligned with passageways 260, 262, and 264, respectively. Moreover, nozzle center passageway 270 is aligned substantially concentrically with head center passageway 214. As such, first tube 250 is substantially aligned with head first divider wall 222, second tube 252 is substantially aligned with head second divider wall 224, and third tube 254 is substantially aligned with head third divider wall 226. In the exemplary embodiment, fourth tube 256 is aligned such that an inner surface 273 of fourth tube 256 is substantially aligned with a radially outer surface 274 of head channel 220.

In the exemplary embodiment, nozzle portion 204 includes a tip portion 280 coupled to tubes 250, 252, 254, and/or 256. More specifically, in the exemplary embodiment, tip portion 280 is coupled to tubes 250, 252, 254, and/or 256 using, for example, a welding process. In the exemplary embodiment, tip portion 280 includes a tube extension 282, an outer tip 284, and an inner tip 286. Alternatively, tip portion 280 may have any suitable configuration that enables secondary fuel nozzle assembly 200 to function as described herein. In the exemplary embodiment, tube extension 282 is coupled to third tube 254 and fourth tube 256 using, for example, a coupling ring 288. Coupling ring 288 facilitates sealing third passageway 264 such that a fluid (not shown) flowing within third passageway 264 is not discharged through tip portion 280. Alternatively, third passageway 264 is coupled in flow communication through tip portion 280.

In the exemplary embodiment, inner tip 286 includes a first projection 290 and a second projection 292. Inner tip 286 further defines a center opening 294 and a plurality of outlet apertures (not shown). Inner tip 286 is coupled to first tube 250 and second tube 252 using first projection 290 and second projection 292, respectively. As such, in the exemplary embodiment, a fluid (not shown) flowing within center passageway 214 and/or center passageway 270 is discharged through center opening 294 and/or the outlet apertures, and a fluid (not shown) flowing within first passageway 260 is discharged through the outlet apertures. Further, in the exemplary embodiment, outer tip 284 includes a plurality of outlet apertures (not shown) and is coupled to inner tip 286 and tube extension 282. As such, a fluid (not shown) flowing within second passageway 262 is discharged through the outlet apertures defined in outer tip 284 and/or inner tip 286.

In the exemplary embodiment, nozzle portion 204 also includes at least one peg 300 (also referred to herein as "vanes") that extends radially outwardly from fourth tube 256. As shown in FIG. 2, each peg 300 is in fuel flow communication with nozzle portion 204 through fourth tube 256. Alternatively, pegs 300 may extend obliquely from nozzle portion 204. Further, although only two pegs 300 are shown in FIG. 2, nozzle portion 204 may include more or less than two pegs 300. In the exemplary embodiment, pegs 300 are positioned at a downstream end 302 of third passageway 264 proximate to coupling ring 288. Alternatively, one or more pegs 300 may be positioned at any suitable location relative to third passageway 264.

Referring further to FIG. 3, in the exemplary embodiment, each peg 300 defines at least one outlet aperture or opening 304 configured to discharge fuel flowing within third passageway 264 through openings 304 and direct the fuel in a substantially upstream direction opposing a flow of combustion gases in a downstream direction.

A disc 310 is positioned about nozzle portion 204 upstream of pegs 300. Disc 310 is configured to interfere with the fuel to facilitate fuel atomization. More specifically, the collision of the fuel with an inner or downstream surface 312 of disc 310 facilitates atomization of the fuel. The atomized fuel 314 disperses and mixes with the flow of combustion gases and/or air that flows through combustor liner 126 in a substantially downstream direction, represented by arrows 316 in FIG. 3.

In the exemplary embodiment, disc 310 has a semi-toroidal shape, as shown in FIG. 3. The semi-toroidal shaped disc 310 is circumferentially positioned about and coupled to nozzle portion 204. The semi-toroidal shaped disc 310 may be a continuous disc 310 or may include a plurality of disc segments (not shown) circumferentially positioned about nozzle portion 204. Referring further to FIG. 3, in the exemplary embodiment, at least a portion of downstream surface 312 of disc 310 has an arcuate cross-sectional profile, such as a semi-circular or concave cross-sectional profile, as shown in FIG. 3, to facilitate directing the fuel in a direction of the flow of combustion gases upon contact with downstream surface 312.

In an alternative embodiment, disc 310 includes a substantially planar downstream surface (not show) configured to interfere with the fuel to facilitate fuel atomization. In this alternative embodiment, the substantially planar surface is positioned at a perpendicular angle or an oblique angle with respect to a flow of fuel from pegs 300.

In the exemplary embodiment, nozzle portion 204 is coupled to head portion 202 using a suitable process including, without limitation, a welding process. More specifically, each tube 250, 252, 254, and/or 256 is coupled to head portion 202 such that nozzle passageways 260, 262, 264, and 270 are substantially aligned with cooperating head channels 216, 218, 220, and head center passageway 214, as described above. In the exemplary embodiment, tip portion 280 is welded to tubes 250, 252, 254, and/or 256 such that nozzle portion 204 is configured as described above. More specifically, in the exemplary embodiment, tube extension 282 is welded to tubes 254 and 256 using, for example, coupling ring 288, inner tip 286 is welded to second tube 252 and first tube 250 using respective projections 292 and 290, and outer tip 284 is welded to inner tip 286. Alternatively, nozzle portion 204 may be fabricated using any other suitable fabrication technique that enables secondary fuel nozzle assembly 200 to function as described herein.

The above-described secondary fuel nozzle assembly includes fuel pegs that are oriented in an upstream direction to provide a flow or spray of fuel that contacts a semi-toroidal shaped disc of the secondary fuel nozzle assembly to increase fuel atomization and/or fuel mixing. More specifically, the semi-toroidal shaped disc interferes with the flow of fuel in the upstream direction to facilitate mixing the fuel with a flow of air through the secondary fuel nozzle assembly and redirecting the mixed fuel into a flow of combustion gases through the combustor assembly. The mixed fuel is redirected or sprayed into the flow of combustion gases rather than directly dumped into the flow of combustion gases, as in conventional secondary fuel nozzle assemblies. As a result, a fuel spray pattern is created using reflecting waves produced by the semi-toroidal shaped disc to facilitate fuel dispersion and/or atomization.

Exemplary embodiments of a secondary fuel nozzle assembly and methods for fabricating a secondary fuel nozzle assembly are described above in detail. The assembly and methods are not limited to the specific embodiments described herein, but rather, components of the assembly and/or steps of the method may be utilized independently and separately from other components and/or steps described herein. Further, the described assembly components and/or method steps can also be defined in, or used in combination with, other assemblies and/or methods, and are not limited to practice with only the assembly and methods as described herein.

While the invention has been described in terms of various specific embodiments, those skilled in the art will recognize that the invention can be practiced with modification within the spirit and scope of the claims.

What is claimed is:

1. A method for fabricating a secondary fuel nozzle assembly, said method comprising:

providing a nozzle portion defining a passageway configured to supply fuel;

operatively coupling at least one peg in fuel flow communication with the passageway, the at least one peg extending radially outward from the nozzle portion and defining at least one opening configured to direct a flow of fuel in a substantially upstream direction; and positioning a disc about the nozzle portion upstream of the at least one peg, the disc positioned in communication with the at least one opening and configured to interfere with the flow of fuel to facilitate fuel atomization.

2. A method in accordance with claim 1 wherein said positioning a disc about the nozzle portion upstream of the at least one peg further comprises coupling a semi-toroidal shaped disc to the nozzle portion.

3. A method in accordance with claim 2 further comprising circumferentially positioning the semi-toroidal shaped disc about the nozzle portion.

4. A method in accordance with claim 2 wherein said positioning a disc about the nozzle portion upstream of the at least one peg further comprises forming a downstream surface of the semi-toroidal shaped disc having an arcuate cross-sectional profile to facilitate redirecting the flow of fuel in a direction of a flow of combustion gases.

5. A method in accordance with claim 1 further comprising coupling a head portion to the nozzle portion, the head portion including a plurality of inlets, wherein each inlet of said plurality of inlets is in flow communication with at least one of a plurality of nozzle passageways.

6. A secondary fuel nozzle assembly comprising:

a nozzle portion;

at least one peg extending radially outward from said nozzle portion, said at least one peg defining at least one opening configured to direct a flow of fuel in a substantially upstream direction; and a disc positioned about said nozzle portion upstream of said at least one peg, said disc positioned in flow communication with the said at least one opening and configured to interfere with the flow of fuel to facilitate fuel atomization.

7. A secondary fuel nozzle assembly in accordance with claim 6 wherein said disc further comprises a semi-toroidal shaped disc.

8. A secondary fuel nozzle assembly in accordance with claim 7 wherein said semi-toroidal shaped disc is circumferentially positioned about said nozzle portion.

9. A secondary fuel nozzle assembly in accordance with claim 8 wherein said semi-toroidal shaped disc is segmented.

10. A secondary fuel nozzle assembly in accordance with claim 7 wherein a downstream surface of said semi-toroidal shaped disc has an arcuate cross-sectional profile to facilitate redirecting the flow of fuel in a direction of a flow of combustion gases.

11. A secondary fuel nozzle assembly in accordance with claim 6 wherein said disc is circumferentially positioned about said nozzle portion, said disc having a substantially planar downstream surface configured to interfere with the flow of fuel to facilitate fuel atomization.

12. A secondary fuel nozzle assembly in accordance with claim 11 wherein said substantially planar downstream surface is positioned at one of a perpendicular angle and an oblique angle with respect to the flow of fuel from said at least one peg.

13. A secondary fuel nozzle assembly in accordance with claim 6 further comprising a head portion coupled to said nozzle portion, said head portion comprising a plurality of inlets, wherein each inlet of said plurality of inlets is in flow communication with at least one nozzle passageway of a plurality of nozzle passageways.

14. A combustor assembly for use with a gas turbine engine, said combustor assembly comprising:

a combustor liner defining a primary combustion zone and a secondary combustion zone, said combustor liner configured to direct a flow of combustion gases substantially in a downstream direction;

a primary fuel nozzle assembly extending into said primary combustion zone; and a secondary fuel nozzle assembly extending through said primary combustion zone and into said secondary combustion zone, said secondary fuel nozzle assembly comprising:

a nozzle portion;

at least one peg extending radially outward from said nozzle portion, said at least one peg defining at least one opening configured to direct a flow of fuel in an upstream direction opposing the downstream direction; and a disc positioned about said nozzle portion upstream of said at least one peg, said disc configured to interfere with the flow of fuel to facilitate fuel atomization.

15. A combustor assembly in accordance with claim 14 wherein said disc comprises a semi-toroidal shaped disc.

16. A combustor assembly in accordance with claim 15 wherein a downstream surface of said semi-toroidal shaped disc has an arcuate cross-sectional profile to facilitate redirecting the flow of fuel in the direction of the flow of combustion gases.

17. A combustor assembly in accordance with claim 14 wherein said secondary fuel nozzle assembly further comprises a head portion coupled to said nozzle portion, said head portion comprising a plurality of inlets, wherein each inlet of said plurality inlets is in flow communication with at least one nozzle passageway of said plurality of nozzle passageways.

18. A combustor assembly in accordance with claim 14 wherein said nozzle portion further comprises a central passageway and a plurality of passageways that are each concentrically-aligned with said central passageway.

19. A combustor assembly in accordance with claim 18 wherein said secondary fuel nozzle assembly nozzle portion is configured to inject a selected amount of pilot fuel through a first passageway of said plurality of passageways and inject a selected amount of main fuel through a second passageway of said plurality of passageways, wherein each passageway of said plurality of passageways is configured to be controlled independently.

* * * * *